United States Patent [19]

Kaffka

[11] Patent Number: 4,768,293

[45] Date of Patent: Sep. 6, 1988

[54] FOOTWEAR DRYING APPARATUS

[76] Inventor: Michael G. Kaffka, 787 - 22nd Street, West Vancouver, British Columbia, Canada, V7V 4C1

[21] Appl. No.: 48,545

[22] Filed: May 11, 1987

[51] Int. Cl.[4] ..... F26B 9/00

[52] U.S. Cl. ..... 34/104; 219/366; 219/369

[58] Field of Search ..... 219/369, 366, 370, 367, 219/368; 34/104

[56] References Cited

U.S. PATENT DOCUMENTS

| | | | |
|---|---|---|---|
| 2,856,700 | 10/1958 | Wales | 34/151 |
| 3,154,392 | 10/1964 | Littman | 34/104 |
| 3,299,529 | 1/1967 | Roberts et al. | 34/104 |
| 4,145,602 | 3/1979 | Lee . | |
| 4,171,580 | 10/1979 | Vabrinskas | 34/104 |

FOREIGN PATENT DOCUMENTS

| | | | |
|---|---|---|---|
| 694904 | 7/1940 | Fed. Rep. of Germany | 34/104 |

*Primary Examiner*—Larry I. Schwartz
*Attorney, Agent, or Firm*—Bull, Housser & Tupper

[57] ABSTRACT

Apparatus for blowing air into footwear for warming and/or drying the footwear. The apparatus has a seal for sealing an open or ankle portion of the footwear, and a duct assembly having intake and exhaust ports, and a discharge tube. The seal encircles the discharge tube and has a range of effective diameters to accommodate open portions of footwear of different sizes. The discharge tube is telescopically extensible and retractable of the seal to accommodate footwear of different heights and to retract within the seal for storage. A fan, communicating with the duct assembly and a heating element, draws air into the intake duct and discharges it through the discharge tube into the shoe. The apparatus can be used to warm and/or dry footwear ranging from high stiff ski boots to low soft running shoes, and accommodates a wide range of sizes of such footwear.

18 Claims, 2 Drawing Sheets

FOOTWEAR DRYING APPARATUS

BACKGROUND OF THE INVENTION

The invention relates to an apparatus for drying and/or heating footwear, such as ski boots, ice skates, running shoes etc.

Several devices have been patented for drying and/or warming footwear by blowing a stream of warm air into the footwear. Prior devices are disclosed in U.S. Pat. Nos. 2,299,529, issued to Roberts et al., 4,145,602, issued to Lee, and 4,171,580 issued to Vabrinskas.

Some prior art devices tend to be rather bulky and complex, and thus commonly are not easily portable and tend to be costly to manufacture. Also, some prior art devices are adaptable to dry only a relatively narrow range of sizes of footwear. Consequently this type of device could not be used to dry footwear of young children having small feet, as well as drying the footwear of adults having larger sizes of feet. Consequently, at least two different sizes of foot drying apparatus of the prior art normally would be required. Also, many devices of the prior art utilize a discharge duct which passes freely through an open or ankle portion of the footwear to discharge heated air adjacent the ankle or towards the toe of the footwear. Air from inside the footwear, now moist and cooler, usually passes upwardly to exhaust through a clearance space between the discharge duct and open portions of the footwear. Clearly, if the footwear open portion is relatively small, and the duct is relatively large, the space for exhausting cooler moist air is restricted by the discharge duct, and poor circulation of air within the footwear can result. Conversely, attempting to dry (or warm) relatively large footwear with a relatively small discharge duct can produce a relatively low volume of heated air for drying the boot, which increases drying time unnecessarily.

SUMMARY OF THE INVENTION

The invention reduces the difficulties and disadvantages of the prior art by providing an apparatus for drying and/or warming boots in which the apparatus can accommodate boots of widely different sizes. Thus the same apparatus can be used for drying relatively small children's footwear, and also for larger, adult-sized footwear. Furthermore, the clearance space between the discharge duct discharging heated air into the footwear, and the open or ankle portion of the footwear receiving the duct is controlled. Thus, exhaust from the footwear cannot be restricted by relatively small footwear, thus maintaining an adequate discharge of cooled moist air from inside the boot, which improves circulation and expedites drying. Furthermore, the device has telescopic members which can retract within other portions, thus accommodating footwear of difference heights and reducing folded size of the apparatus to facilitate storage. Also, the device is relatively simple mechanically, can be made for relatively low cost and requires negligible maintenance.

An apparatus according to the invention is for blowing air into footwear and includes a duct assembly, a fan and a sealing means. The duct assembly includes an intake port, a discharge tube and an exhaust port. The fan communicates with the duct assembly and is powered to draw air into the intake port, and to discharge the air through the discharge tube. The sealing means is for engaging an open portion of an item of footwear to provide an adequate seal therewith, the sealing means encircling the discharge tube and having accommodation means for accommodating open portions of footwear of widely different sizes. The discharge tube is axially extensible and retractable of the sealing means to accommodate the open portions of footwear of different heights, and to retract within the sealing means for storage. Preferably, the discharge tube has a plurality of telescoping tube sections which permit extension and retraction thereof. The discharge tube also has a tube inner portion adjacent the sealing means, and a tube outer portion which is curved so as to direct air towards a toe end of the footwear. Preferably, the sealing means and accommodating include a hollow truncated conical member which tapers downwardly from a wider portion to a narrower inner end portion. Thus, the conical member has a range of effective diameters so as to permit insertion into, and effective sealing with, open portions of footwear of different opening sizes. A heater means within the duct can heat air prior to discharge into the footwear.

A detailed disclosure following, related to drawings, describes a preferred embodiment of the invention which is capable of expression in structure other than that particularly described and illustrated.

DETAILED DISCLOSURE

Figure 1:
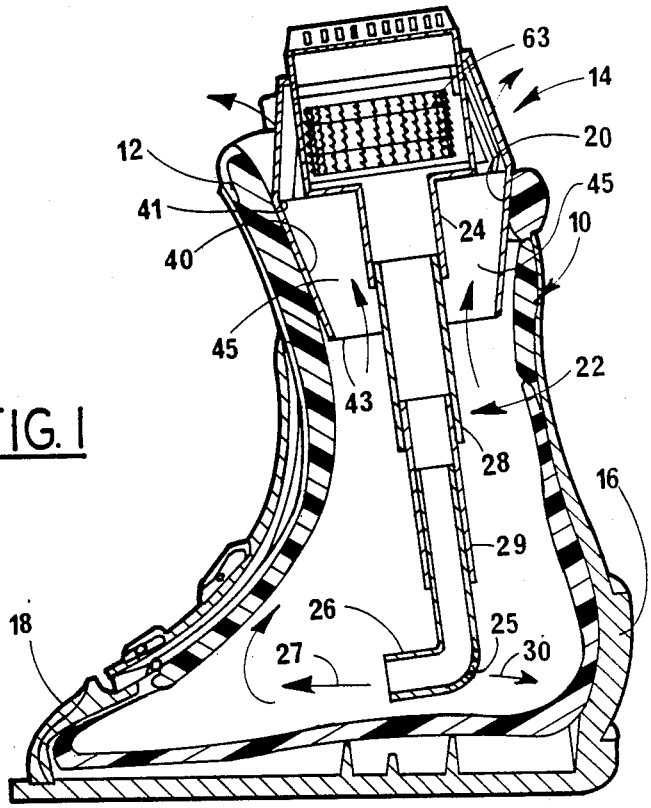
FIG. 1 is a simplified fragmented section through a ski boot fitted with an apparatus according to the invention, a portion of the apparatus being showed simplified and in partial section.
Figure 2:
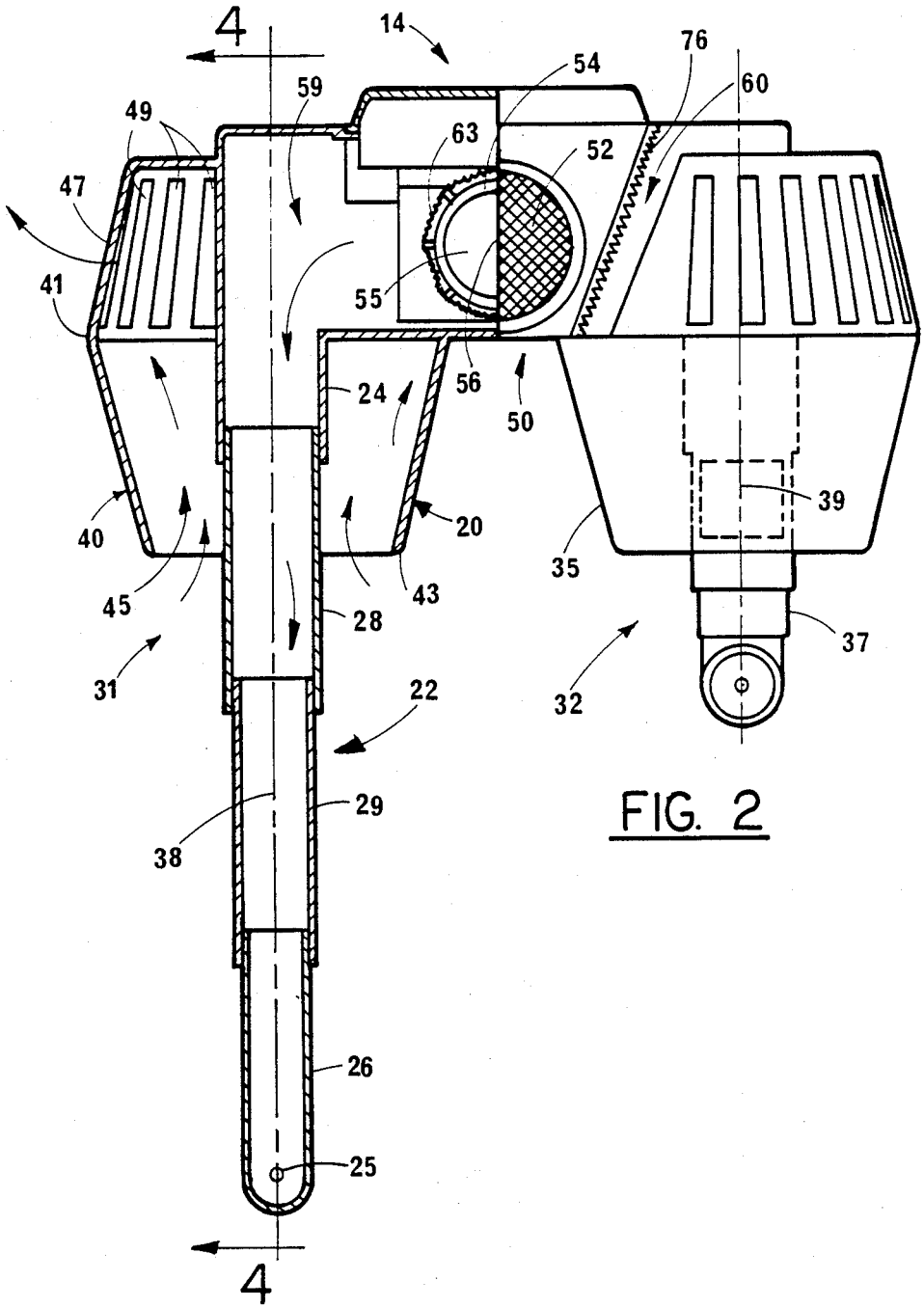
FIG. 2 is a simplified front elevation of the apparatus, with one portion of the apparatus shown in section in a fully extended position to cooperate with a large boot, and another portion of the apparatus shown in elevation partially retracted to cooperate with a smaller boot.

FIGS. 1 and 2

A ski boot 10 has an upper open portion, ankle portion or cuff 12 which receives a drying apparatus 14 according to the invention. The boot has a heel portion 16, disposed below the open portion 12, and a toe portion 18 disposed oppositely to the heel portion.

The apparatus 14 has a sealing means 20 which engages the open portion of the boot to provide an adequate seal therewith and to support the apparatus as will be described. The apparatus has a discharge tube 22, to receive air as will be described, which has a tube inner portion or section 24 adjacent the sealing means, and a tube outer portion or section 26 which is curved to form an elbow portion so as to direct air towards the toe end 18 of the footwear, shown by arrow 27. A rear facing portion of the section 26 can have a relatively small opening 25 to direct a portion of air rearwardly as shown by arrow 30.

The discharge tube has a plurality of telescoping tube sections, two inner sections being designated 28 and 29 respectively which, with the outer section 26 permit relative extension and retraction of the tube sections relative to the sealing means 20.

As seen in FIG. 1, the apparatus 14 is shown with the discharge tube 22 extended towards a maximum extension, so as to accommodate a boot having a relatively high open portion. As will be described, the discharge tube 22 is adaptable to accommodate shoes having different heights.

The apparatus 14 shown in FIG. 1 cooperating with the boot 10 is approximately one-half, i.e. a right portion, of an apparatus which can simultaneously dry two boots. Referring to FIG. 2, the apparatus 14 has a right portion 31, and a generally similar left portion 32. The apparatus includes the first sealing means 20 for the right portion, and a second sealing means 35 for the left portion. The sealing means engage open portions of each item of footwear, not shown in FIG. 2, to provide an adequate seal therewith. The left portion has a second telescoping discharge tube 37 which is shown partially retracted in FIG. 2 to accommodate shoes of a different size. The discharge tubes 22 and 37 have respective central axes 38 and 39 which are spaced apart and disposed parallel to each other. Clearly, in practice it would be normal to use the apparatus with boots of the same pair, i.e. the same size, but, if necessary, as seen in FIG. 2, the apparatus could be used to process simultaneously one boot of two pairs of different sizes. The pair of boots would be placed side by side, and the axes 38 and 39 are spaced apart sufficiently to enable the sealing means 20 and 35 to engage simultaneously cuffs of boots of maximum width.

As seen in FIGS. 1 and 2, the sealing means 20 includes a hollow truncated conical member 40 which tapers downwardly from a wider portion 41 to a narrower inner end portion 43. The inner end portion has a diameter somewhat less than the smallest open portion of footwear that would accommodate the apparatus. The wider portion 41 has a diameter somewhat greater than the largest open portion of footwear which would accommodate the apparatus. Consequently, the taper between the narrower inner portion 43 and the wider portion 41 provides an accommodation means with a range of effective diameters and permits insertion into, and provides effective sealing of the apparatus with, open portions of footwear of different opening sizes. It can be seen that the sealing means has a generally hollow lower shell portion, i.e. the member 40, having an outer wall which is adapted to seal against open portions of footwear. The discharge tube 22 extends centrally downwardly through the lower shell portions so as to define in part a generally annular space 45 between the discharge tube and the lower shell portion.

The right portion 31 also includes an upper hollow shell portion 47 having a plurality of elongated openings 49 which extend axially and are spaced circumferentially partially therearound. The openings 49 communicate with the space 45 and provide exhaust ports to discharge air from the boot as will be described.

It can be seen that the lower shell portion, that is the member 40, and the upper shell portion 47 are concentric, generally truncated conical portions which have coincident portions of generally equal maximum diameters, at the wider portion 41, and extend downwardly and upwardly respectively from the coincident portions to form sealing means and exhaust assemblies.

Figure 6:
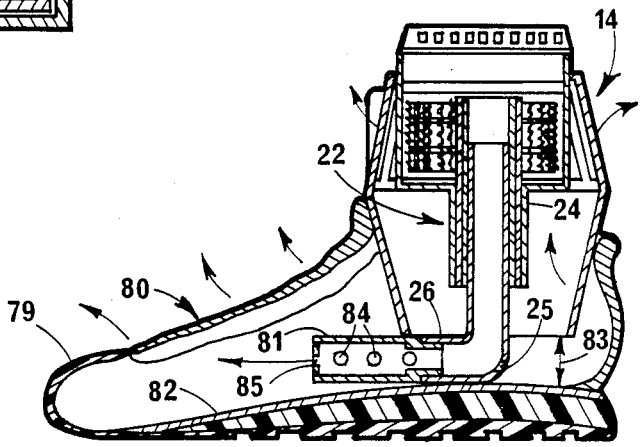
FIG. 6 is a simplified fragmented section of one portion of the apparatus shown partially retracted and fitted in a relatively low cut shoe, such as a running shoe, with an optional extension fitted.

It can be seen that the sealing means 20 encircles the discharge tube, and the space 45 receives air from inside the boot and conducts the air to the exhaust ports 49. The space 45 provides a clear route to the exhaust ports 49, which cannot be restricted by fitting in a small sized boot. Consequently, in contrast with some prior art apparatus, the exhaust ports of the present invention cannot be restricted by smaller sized footwear, which might otherwise tend to reduce drying effectiveness and/or cause overheating. In this regard, however, special pracautions are required with softer or low cut shoes, as shown in FIG. 6.

Figure 3:
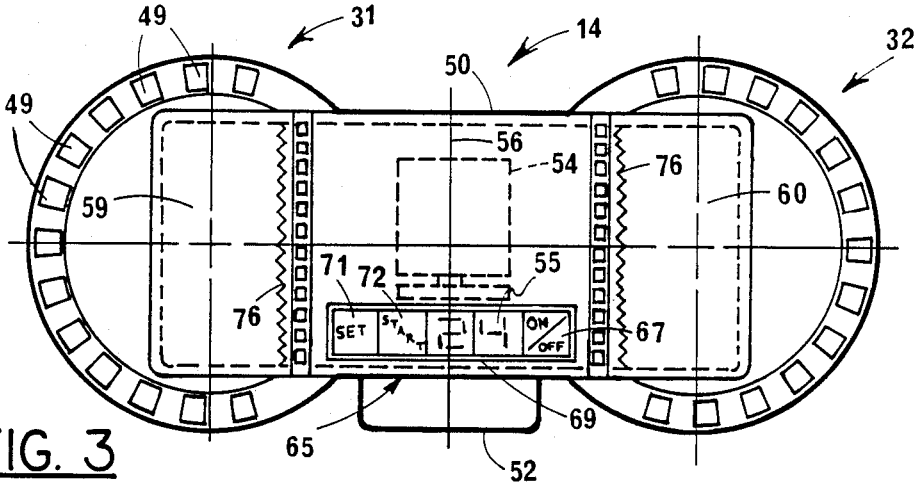
FIG. 3 is a simplified top plan of the apparatus.

FIGS. 2 and 3

The apparatus 14 has a central portion 50 which interconnects the portions 31 and 32 and has an intake port 52. The apparatus thus has a duct assembly including the intake port 52, the discharge tube 22 and the exhaust port 49. A fan 55 is mounted on an electic motor 54 and is powered to rotate about an axis 56 and to draw air in through the intake port 52. The central portion 50 contains oppositely extending inner duct portions 59 and 60 which communicate with the discharge tubes 22 and 37 respectively. Thus, air drawn through the intake port 52 is discharged from the central portion 50 through the inner duct portions 59 and 60, and down the tubes 22 and 37 so as to discharge into the footwear. An electrical heating element 63 is exposed to air as it passes through the fan, and thus warms the air prior to discharging into the boot. The fan 55, motor 54 and element 63 can be similar to those used in a conventional hand-held hair dryer. A control unit 65 has an on/off switch 67, and set and start buttons 71 and 72 respectively, and a timer display 69 for establishing and displaying a desired time during which the heater and fan operates.

FIGS. 4 AND 5

Figure 4:
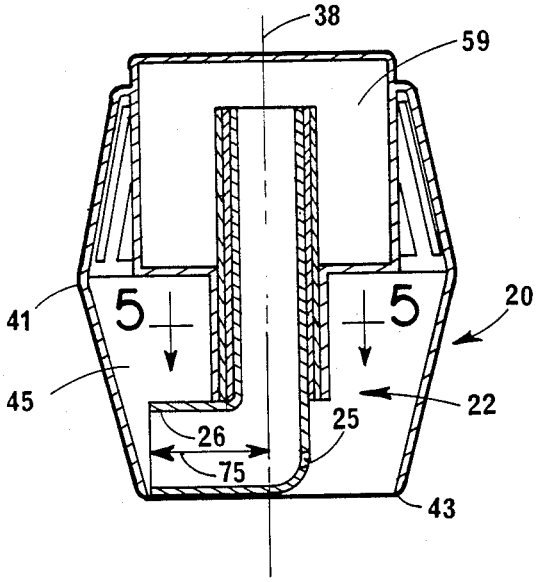
FIG. 4 is a simplified fragmented section of a portion of the apparatus, as would be seen on line 4—4 of FIG. 2, but instead with a discharge duct of the apparatus shown fully retracted.

As best seen in FIG. 4, when the telescoping discharge tube 22 is fully retracted, the outer or elbow portion 26 is fully received within the narrower inner end portion 43, so as to facilitate storage. In this way, the telescoping tubes, which might otherwise be vulnerable to damage, are safely retracted within the sealing means and unlikely to be damaged. Thus, the elbow portion 26 extends a distance 75 from the central axis 38 of the tube, which distance is less than radius of the narrow inner end portion 43, so as to permit complete retraction thereinto.

Figure 5:
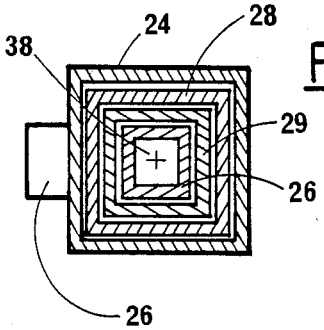
FIG. 5 is a simplified section of a portion of the discharge duct, as seen from line 5—5 of FIG. 4, wall thickness being exaggerated.

As best seen in FIG. 5, the telescoping tube sections 24, 26, 28 and 29 have square cross-sections, which permit easy axial sliding therebetween, but prevent rotation about the respective axis 38. This is to ensure that, when the apparatus is fitted within the footwear, the outer portion 26 of the discharge tube is always directed towards the toe end of the footwear. Clearly, if the tube sections of the discharge tube 22 were circular in cross-section with no means to prevent relative rotation, the outer portion or elbow section 26 would be free to rotate about the axis 38 and might direct air towards the heel portion 16, which would reduce circulation adjacent the narrower toe portion 18 of the boot. Alternately, a key and keyway could be used with a circular-sectioned tube 22 to prevent the relative rotation. The square cross-sections, or alternative non-circular cross-sections, serve as means for preventing relative rotation between adjacent telescoping sections, and relative rotation between the telescoping sections and the sealing means.

The first and second sealing means 20 and 35 and discharge tubes 22 and 37 are generally concentric relative to respective central axes 38 and 39 to cooperate with a pair of items of footwear arranged side by side. The intake port 52 and fan means are disposed symmetrically relative to the discharge tubes 22 and 37 so as to essentially equalize flow therethrough into the respective footwear.

Preferably, for ease of manufacturing and servicing, the apparatus is assembled as two main sub-assemblies as follows. A first sub-assembly includes all the electrical structure, including associated controls and electrical supply wire and plug, not shown, the motor, fan, etc., and including the intake duct and an upper portion of ducting extending in the central portion 50 between the two sealing means. The second sub-assembly includes the two sealing means and associated discharge tubes, plus a lower portion of ducting of the central portion which interconnects the two sealing means. Approximate positions of some lines of separation between the two sub-assemblies are shown as zig-zag lines 76 in FIGS. 2 and 3.

OPERATION

Assuming a pair of boots or the like is to be dried, the two boots are arranged side by side with toes pointing in the same direction. The discharge tubes 22 and 37 are adjusted telescopically so as to have approximately the correct extension so that, when the sealing means engage cuffs of the boots, the discharge portions of the tubes are located to point approximately centrally of the boot towards the toe portion, that is clear of upper portions of the boot to ensure a penetrating circulation of air. The sealing means are pushed down gently to be engaged by the cuffs and the boot opening adjusted so as to provide an adequate seal therebetween, and the electric fan and heater are switched on, and the timer set for the desired time. The fan communicates with the duct assembly and draws air into the intake port and discharges it, after heating, through the discharge tube into the boot. Hot air from the tube dries the inside of the boot, with moist cooler air passing upwardly through the annular space 45 so as to discharge through the exhaust ports 49. Undesignated arrows show air flow relative to the boot. If desired, the heater can be switched off, and thus unheated air can be blown into the boot.

FIG. 6

The apparatus 14 is shown in FIG. 1 cooperating with the relatively high, stiff ski boot 10 which is sufficiently strong to support the weight of the apparatus. The elbow portion 26 can thus be clear of a lower inner surface of the inside of the boot, but it is not important if the portion 26 touches the said lower surface. In FIG. 6, a relatively low cut soft running shoe 80 is shown being dried with the apparatus 14. In this instance, the telescoping discharge tube 22 is partially retracted into the sealing means as shown. Because the shoe is relatively soft and the cuff thereof deforms easily, weight of the apparatus is probably shared between the shoe contacting the sealing means, and the discharge duct. The shoe has a lower inner surface 82 which contacts the elbow portion 26. A perforated extension tube 81 is fitted to extend outwardly and axially from the outer portion 26 towards a toe 79 of the shoe and contacts the narrower inner end portion 43 of the sealing means. The extension tube 81 has connection means at an inner end thereof to engage the outer end of the discharge tube outer section 26 to receive and discharge air from the discharge tube. The extension tube has a side wall having a plurality of lateral openings 84 to provide perforations which discharge air laterally from the extension tube. An outer end of the tube 81 has a relatively small axial opening 85, approximately the size of a perforation opening, which restricts flow of air forwardly, so as to ensure that an adequate flow of air is directed to the lateral openings, and to the rearward opening 25 of the outer portion 26.

Interference between the extension 81 and the end portion 43 of the sealing means prevents the sealing means passing completely over the open end of the outer portion 26, i.e. complete retraction of the discharge tube into the sealing means, which could otherwise happen. Clearly, if the telescoping tube sections are a relatively loose fit, weight of the apparatus resting on the outer portions 26 could be sufficient to cause the apparatus to move downwardly until the narrower end portion 43 interfered with the lower inner surface 82 of the shoe, at which time the elbow 26 would be enclosed completely by the sealing means as in the fully retracted condition shown in FIG. 4. Thus the extension tube has a length such that, when engaging the discharge tube, the sealing means interferes with the extension tube and prevents complete retraction of the discharge tube into the sealing means. Clearly, if the tube portion 26 were fully retracted into the sealing means as shown in FIG. 4, hot air discharged down the discharge tube 22 would pass immediately into the annular space 45 and would then discharge through the exhaust means without first passing through the shoe.

Clearly, the said interference with the perforated extension tube 81 is necessary to prevent such an occurrence as described above, so as to ensure that hot air from the tube 22 passes away from the sealing means into the shoe towards the toe, and then circulates around the shoe and exhausts. Thus the extension tube 81 maintains a clearance space 83 between the inner end portion 43 and the lower inner surface 82 of the shoe. Length of the extension tube 81 can be made variable by adding additional sections, if required, so as to ensure that hot air is fed towards the toe 79 of the shoe.

Because porosity of a running shoe is much greater than that of a ski boot, the perforations and small openings 25 and 85 are considered necessary to ensure that air is distributed laterally, forwardly and rearwardly from the tubes to ensure generally even distribution of warm air throughout the interior of the shoe.

I claim:

1. An apparatus for blowing air into the interior of an item of footwear, the apparatus including:

(a) a duct assembly including an intake port and a discharge tube, (b) a fan communicating with the duct assembly and being powered to draw air into the intake port and to discharge the air through the discharge tube into the interior of the footwear, (c) sealing means for engaging an open portion of the item of footwear to provide an adequate seal therewith, the sealing means encircling the discharge tube and having accommodation means for accommodating open portions of footwear of widely different opening sizes, (d) an exhaust port to permit air from the interior of the footwear to flow past the sealing means to atmosphere, (e) the discharge tube being axially extensible and retractable of the sealing means to accommodate the open portions of footwear of different heights, and to retract within the sealing means for storage.

2. An apparatus as claimed in claim 1 in which:

(a) the discharge tube has a plurality of telescoping tube sections which permit extension and retraction thereof, the discharge tube having a tube inner portion adjacent the sealing means and a tube outer portion which is curved so as to direct air towards a toe end of the footwear.

3. An apparatus as claimed in claim 2 in which:

(a) the telescoping sections include means for preventing relative rotation between adjacent telescoping sections, and relative rotation between the telescoping sections and the sealing means, so as to ensure that, when the apparatus is fitted within the footwear, the outer portion of the discharge tube is always directed towards the toe end of the footwear.

4. An apparatus as claimed in claim 1 in which:

(a) the sealing means has a hollow inner end portion, (b) the discharge tube is retractable to fit within the inner end portion of the sealing means.

5. An apparatus as claimed in claim 1 in which:

(a) the sealing means and accommodating means include a hollow truncated conical member which tapers downwardly from a wider portion to a narrower inner end portion to provide a range of effective diameters, so as to permit insertion into and effective sealing with the open portions of footwear of different opening sizes.

6. An apparatus as claimed in claim 5 in which:

(a) the discharge tube has a plurality of telescoping sections which permit relative extension and retraction, the discharge tube having a tube inner portion adjacent the wider portion of the sealing means, and a tube outer portion which can be retracted to fit within the narrower inner end portion of the sealing means, (b) the tube outer portion is curved to form an elbow portion so as to direct air towards a toe end of the footwear.

7. An apparatus as claimed in claim 1 in which:

(a) the sealing means has a generally hollow lower shell portion having an outer wall which is adapted to seal against open portions of footwear, (b) the discharge tube extends centrally downwardly through the lower shell portion so as to define in part a generally annular space between the discharge tube and the lower shell portion, (c) the exhaust port communicates with the generally annular space between the shell portion and the discharge tube to receive and exhaust from the apparatus air returned from the item of footwear.

8. An apparatus as claimed in claim 7 in which:

(a) the duct assembly has an upper hollow shell portion which extends upwardly from the sealing means, (b) the exhaust means includes the upper hollow shell portion having a plurality of openings which communicate with the generally annular space between the discharge tube and the lower shell.

9. An apparatus as claimed in claim 8 in which:

(a) the lower shell portion and the upper shell portion are concentric, generally truncated conical portions which have co-incident portions of generally equal maximum diameters, and extend downwardly and upwardly from the co-incident portions to form exhaust duct and sealing means assemblies.

10. An apparatus as claimed in claim 1 in which the apparatus is adapted to blow air simultaneously into a pair of items of footwear, the apparatus including:

(a) first and second sealing means for engaging open portions of each item of footwear to provide an adequate seal therewith, the sealing means having accommodation means for accommodating open portions of footwear of varying sizes, (b) the duct assembly includes first and second spaced apart discharge tubes to direct air from the fan into the pair of items of footwear, each discharge tube being extensible and retractable of the respective sealing means to accommodate open portions of footwear of different heights, and to retract within the respective sealing means for storage.

11. An apparatus as claimed in claim 10 in which:

(a) the first and second sealing means and discharge tubes are laterally spaced apart and have respective parallel central axes to cooperate with a pair of items of footwear arranged side by side, (b) the intake port and fan means are disposed symetrically relative to the discharge ducts so as to essentially equalize flow therethrough.

12. An apparatus as claimed in claim 1 further including:

(a) heater means for heating air drawn through the intake port, heater means being positioned between the intake port and the discharge duct so that heated air is discharged into the footwear.

13. An apparatus as claimed in claim 10 in which:

(a) the first and second sealing means are spaced laterally apart, (b) the duct assembly include first and second exhaust ports and, first and second discharge ducts, the sealing, means and the exhaust ports being disposed generally symetrically about the respective discharge tube.

14. An apparatus as claimed in claim 1 further including:

(a) a detachable extension tube having connection means at an inner end thereof to engage releasably the outer end of the discharge tube to receive and discharge air from the discharge tube, the extension tube having a length such that, when engaging the discharge tube, the sealing means interferes with the extension tube and prevents complete retraction of the discharge tube into the sealing means.

15. An apparatus as claimed in claim 14 in which:

(a) the extension tube has an outer end having a small opening to restrict airflow therethrough, and a side wall having perforations to discharge air laterally from the extension tube.

16. A boot drying apparatus as claimed in claim 1 in which:

(a) the accommodation means has a range of effective diameters to permit insertion of the apparatus into footwear having open portions of widely different diameters to provide an effective seal with the footwear.

17. An apparatus for blowing air into the interior of an item of footwear, the apparatus including:

(a) a duct assembly including an intake port and a discharge tube, (b) a fan communicating with the duct assembly and being powered to draw air into the intake port and to discharge the air through the discharge tube into the interior of the footwear, (c) sealing means for engaging an open portion of the item of footwear to provide an adequate seal therewith, the sealing means encircling the discharge tube and having accommodation means for accommodating open portions of footwear of different opening sizes, (d) an exhaust port to permit air from the interior of the footwear to flow past the sealing means to atmosphere, (e) the discharge tube being axially extensible and retractable of the sealing means to accommodate the open portions of footwear of different heights, and to retract within the sealing means for storage, (f) the sealing means and accommodating means including a hollow truncated conical member which tapers downwardly from a wider portion to a narrower inner end portion to provide a range of effective diameters, so as to permit insertion into and effective sealing with the open portions of footwear of different opening sizes.

18. An apparatus for blowing air into the interior of an item of footwear, the apparatus including:

(a) a duct assembly including an intake port, and a discharge tube and, (b) a fan communicating with the duct assembly and being powered to draw air into the intake port and to discharge the air through the discharge tube into the interior of the footwear, (c) sealing means for engaging an open portion of the item of footwear to provide an adequate seal therewith, the sealing means encircling the discharge tube and having accommodation means for accommodating open portions of footwear of different opening sizes.

(d) an exhaust port to permit air from the interior of the footwear to flow past the sealing means to atmosphere, (e) the discharge tube being extensible and retractable of the sealing means to accommodate the open portions of footwear of different heights, and to retract within the sealing means, (f) the accommodation means has a range of effective diameters to permit insertion of the apparatus into footwear having open portions of widely different diameters to provide an effective seal with the footwear.

* * * * *